United States Patent [19]

Davis

[11] 4,183,446

[45] Jan. 15, 1980

[54] FOOD CONTAINER WITH INTEGRAL DISH AND COVER

[75] Inventor: Paul Davis, Swampscott, Mass.

[73] Assignee: Sweetheart Plastics, Inc., Wilmington, Mass.

[21] Appl. No.: 913,249

[22] Filed: Jun. 6, 1978

Related U.S. Application Data

[63] Continuation-in-part of Ser. No. 887,298, Mar. 15, 1978, abandoned, which is a continuation of Ser. No. 764,033, Jan. 31, 1977, abandoned.

[51] Int. Cl.[2] ..... B65D 41/16; A47J 41/00; B65D 1/00; B65D 5/48

[52] U.S. Cl. ..... 220/306; 220/3.1; 229/2.5 R; 229/29 M; 229/44 R

[58] Field of Search ..... 220/306, 339, 3.1, 4 B; 229/2.5, 29 M, 44 R

[56] References Cited

U.S. PATENT DOCUMENTS

| | | | |
|---|---|---|---|
| 3,184,133 | 5/1965 | Boyd et al. | 229/29 M X |
| 3,876,130 | 4/1975 | Haase | 229/44 R X |
| 3,935,962 | 2/1976 | Schubert et al. | 220/306 |
| 4,057,169 | 11/1977 | Payne | 220/306 |
| 4,079,880 | 3/1978 | Edwards | 220/306 X |
| 4,127,189 | 11/1978 | Shumrak et al. | 220/306 X |
| 4,132,344 | 1/1979 | Jewell | 220/306 X |
| 4,150,777 | 4/1979 | Cyr et al. | 220/306 X |

*Primary Examiner*—Steven M. Pollard
*Attorney, Agent, or Firm*—Wolf, Greenfield & Sacks

[57] ABSTRACT

A foamed plastic food container having a dish and cover interconnected by a hinge at one end and a latching means at the other end. The hinge is biased towards the open position. The latching means comprises a male flange-like member raised above the rim of the dish and a female member on the cover. The female member comprises an outwardly protruding chamber having an indentation sloping inward toward a shelf, with a U-shaped slot being cut into the indentation and shelf. The slot is substantially wider than the width of the flange thereby permitting easy closing and opening.

5 Claims, 10 Drawing Figures

FOOD CONTAINER WITH INTEGRAL DISH AND COVER

BACKGROUND OF THE INVENTION

This is a continuation-in-part of application Ser. No. 887,298 filed on or about Mar. 15, 1978, now abandoned, which in turn is a continuation of application Ser. No. 764,033 filed Jan. 31, 1977, now abandoned.

The invention in general relates to foamed plastic food containers having an integral dish and cover interconnected by a hinge at one end and a latching means at the other end. More particularly the invention relates to deformable containers that provide secure, positive locking means that automatically latch upon closing the containers.

Economical but sturdy containers are of great importance in the food service industry because they permit food to be handled, stored, and reheated routinely.

Early containers used tab type latching mechanisms and had the disadvantage that they required two operations and generally two hands to close. This is a decided disadvantage in fast food operations where speed and efficiency are essential.

Second generation food containers may be easily closed with one hand but have other disadvantages. This prior art is described in U.S. Pat. Nos. 3,876,130 and 3,935,962 which are hereby incorporated by reference. U.S. Pat. No. 3,876,130 describes a foamed plastic food container having a dish and cover interconnected along a portion of their rims by a hinge. Both the dish and cover have a flat flange integrally connected to that portion of their rim that is not contiguous to the hinge. The cover has a skirt integrally molded to and extending down and away from the flange. A recessed surface, or flute, is molded across the face of the skirt opposite the hinge. A slot is cut through the flute within the vertical area defined by the skirt. When the container is closed the flange on the dish rides up on the inclined plane of the skirt until it slips into the slot. In the closed position the skirt fits around the flange of the dish providing a loose "seal" of the container.

U.S. Pat. No. 3,935,962 in its relevant embodiment (i.e. the embodiment having a hinge) is similar to the U.S. Pat. No. 3,876,130 prior art described above except that it does not have a skirt on its cover, and the indentation is formed in the wall of the dish. As in the U.S. Pat. No. 3,876,130 prior art, the indentation is formed in the container in the side opposite the hinge and a slot is cut in the indentation. When this container is closed the flange, or lip, of the cover rides along the inclined plane formed by the indentation in the wall of the dish until it slips into the slot.

Both of the above-described containers have the advantage that they may be closed with one hand. However, opening either of these containers with one hand is quite difficult, and in the case of U.S. Pat. No. 3,935,962 opening with one hand will result in food spillage unless the container is supported with the other hand or with other means.

Both the prior art containers described above have the disadvantage that after molding they must be trimmed and slotted in two separate operations either on separate machines or on a very expensive die that has cutting capabilities in two directions at 90° to one another. The trimming operation is performed by a die moving downward over the molded container in a direction perpendicular to the base wall and top wall. The slotting operation is performed by a punch or knife moving in a direction parallel to the top wall or base wall. If both the trimming and slotting could be performed on the same operation by cutting dies moving in a single direction, much simpler and much less expensive equipment could be used in the manufacturing process. Furthermore the two-step process of the prior art normally requires additional mechanical handling of the molded container.

SUMMARY OF THE INVENTION

The invention provides a deformable container of the type having a bottom dish and a top cover interconnected by a hinge at one end and a latching means at the other end, the latching means having a male and a female portion. The container can be easily closed and opened with one hand, provides a secure, tight, positive seal between the dish and cover and can be manufactured with only a single cutting and trimming operation.

The container is preferably composed of foam plastic and molded in one piece. The bottom dish comprises a base wall and side walls outwardly inclined from the base wall and terminating at their edges remote from the base wall in a flared first rim. At one end of the dish the rim is integrally molded to the hinge and at the opposite end the first rim terminates at and is integrally molded to the male portion of the latching means. The top cover comprises a top wall and side walls outwardly inclined from the top wall and also terminating in a flared second rim. At one end of the cover the second rim is integrally molded to the hinge and at the opposite end the second rim terminates at and is integrally molded to the female portion of the latching means.

The male portion of the latching means comprises a central segment lying in a plane substantially parallel to the base and displaced above the level of the first rim in a direction away from the base, and supporting segments interconnecting the central segment and the first rim on each side of the central segment. The female portion of the latching means comprises an outwardly protruding chamber extending on the side of the second rim toward the top wall and forming a shelf where it meets the side wall. An inwardly protruding indentation is formed in the chamber toward the inner portion of the shelf. A U-shaped slot is cut into the chamber with the outer circumference of the U being formed in the shelf and the inner circumference of the U being formed in the inwardly protruding indentation. This design of the latching means permits the slot to be formed by a punch, knife, or die moving in a direction perpendicular to the plane of the top wall, bottom wall, and rims. This is possible because the shelf provides a plane parallel to the bottom and top walls and perpendicular to the movement of the die by which the cut may be made. In addition the raised central segment of the male portion of the latching means combined with the extension of the protrusion of the side of the second rim towards the base wall permit such a cut to be made without seriously affecting the structural integrity of the latching means. As a result the slot may be formed on the same machine by a die which moves in the same direction as the die which trims the containers from the sheet. Thus the invention may be manufactured with much simpler machinery than the prior art food containers. Furthermore one operation in which the molded container must be mechanically handled is eliminated, thus reducing the probability of misalignments which produce defective containers.

The hinge, bottom dish, top cover, and the male and female portions of the latching means are designed so that as the cover is rotated about the hinge toward the closed position the central segment of the male portion of the latching means rides on the inwardly sloping indentation until it snaps into the slot. Preferably the width of the slot in a direction perpendicular to the shelf is substantially greater than the thickness of the central segment so that the central segment easily slips into the slot even when the parts are subject to normal distortion. Preferably the hinge is biased so that upon release of the latching means the cover is urged away from the dish to bring the container into its open configuration.

In the preferred form of this invention, the slot is essentially free of radii and rather all sides of the slot are straight. This eliminates all problems of machining and maintaining the punch and die that form the slot. When radii are formed at the corners of the slot it is very difficult to achieve the proper curvature and at the same time provide the precise clearance between the punch and die to make a clean cut of the slot.

The container provided by the invention can be easily closed and opened with one hand. The height of the slot enables the central segment to easily slip into the slot even though the central segment and slot may be distorted due to closing pressure. The bias in the hinge causes the cover to pop open when the central segment is disengaged from the slot by applying pressure to the dish wall just below the central segment.

The invention also provides containers with no undercut or reverse tapers so that they may be easily removed from the mold and nested for efficient distribution and storage, and they may be easily denested by the user.

Numerous other features, objects and advantages of the invention will now become apparent from the following detailed description when read in conjunction with the accompanying drawing, in which:

DETAILED DESCRIPTION

Figure 1:
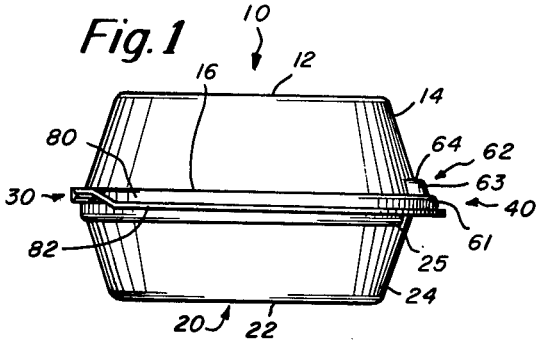
FIG. 1 is a side view of a closed container according to the invention with the hinge on the left and the latching mechanism on the right.

Directing attention to the drawings, the invention will now be described in more detail. FIG. 1 shows the container according to the invention in its closed position. It comprises a top cover 10, a bottom dish 20, interconnected by hinge 30 at one end, and having a latching mechanism 40 at the other end. The invention resides primarily in the latching mechanism and in the intersection of the latching mechanism with other parts of the container, and thus the detailed description will be limited to these aspects, while the rest of the container will be described only generally.

Figure 5:
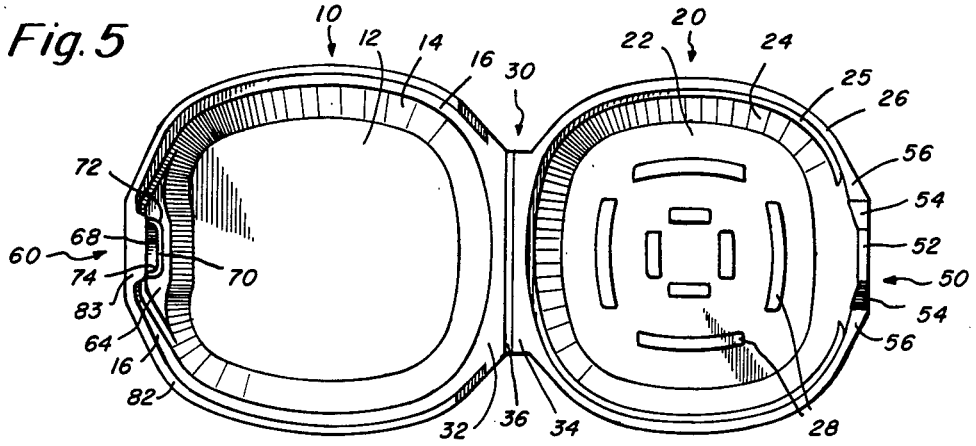
FIG. 5 is a top plane view of the container according to the invention, in the open position.

The one piece molded construction of the container is best shown in FIG. 5. The bottom dish 20 comprises a base wall 22, and side walls 24 outwardly inclined from the base wall and terminating at their edges remote from the base wall in a flared first rim 26. At one end of dish 20 rim 26 broadens into a generally flat portion 34 which forms part of hinge 30. At the other end of dish 20 rim 26 terminates at and is integrally molded to the male portion 50 of latching means 40.

Top cover 10 comprises a top wall 12 and side walls 14 outwardly inclined from top wall 12 and terminating in flared second rim 16. At one end of cover 10 rim 16 broadens into generally flat portion 32 which forms part of hinge 30. At the other end of cover 10 rim 16 terminates at and is integrally molded to female portion 60 of latching means 40.

The male portion 50 of latching means 40 (FIG. 5) comprises a central segment 52 which lies in a plane substantially parallel to base 22 and rim 26, and is displaced above the level of rim 26 in a direction away from base 22, and supporting segments 54 which interconnect central segment 52 and rim 26 on each side of the central segment 52. Preferably rim 26 broadens in the area 56 where it joins supporting segments 54, thus strengthening this critical area.

Figure 4A:
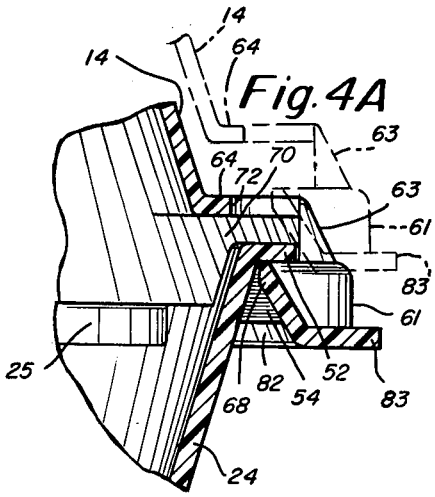
FIG. 4A is an enlarged fragmentary view of a portion of FIG. 4 which also shows in ghost the position of the latching mechanism during the closing operation.
Figure 4:
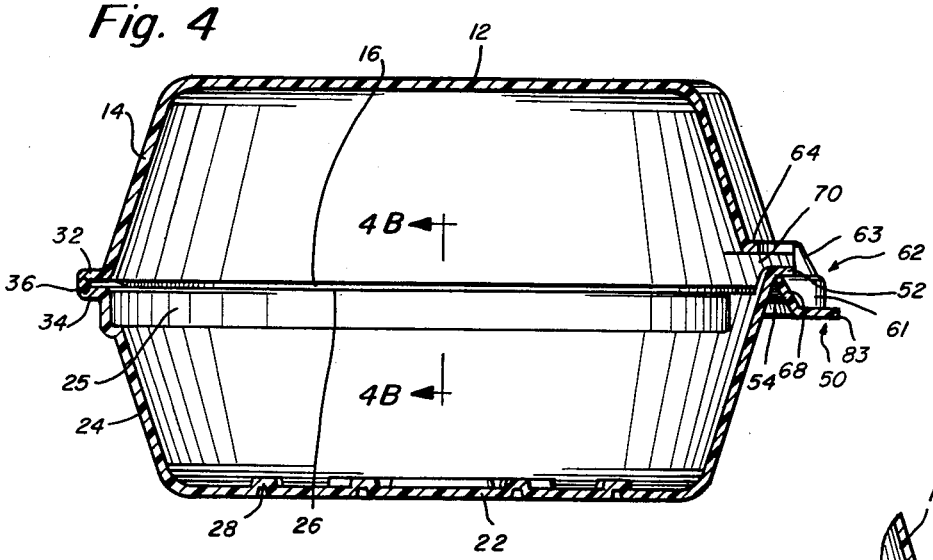
FIG. 4 is a cross sectional view of the invention taken through the line 4—4 of FIG. 3.
Figure 7:
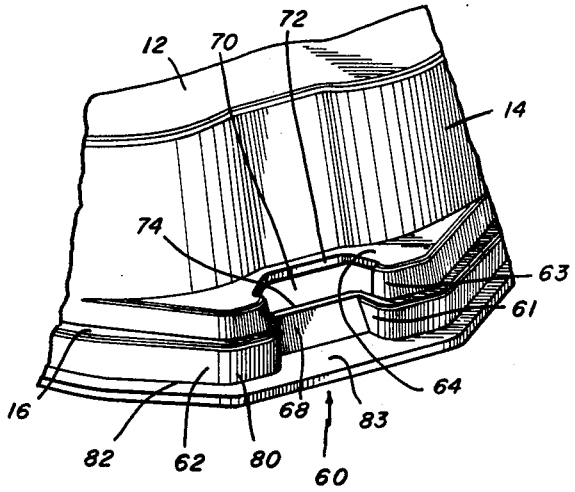
FIG. 7 is a fragmentary perspective view looking down upon the female portion of the latching mechanism of the cover of the container.

Female portion 60 of latching means 40 includes an outwardly protruding chamber 62 (FIGS. 1, 4 and 7) having a portion 63 which extends above rim 16 (i.e. on the side of rim 16 toward top wall 12), and forming a shelf 64 where it meets side wall 14. Shelf 64 is substantially parallel to top wall 12 and rim 16. Chamber 62 preferably also has a portion 61 extending below rim 16 which serves to strengthens this part of the latch. An inwardly protruding indentation 68 is formed in chamber 62. Indentation 68 angles from the outer edge of chamber 62 toward the inner portion of shelf 64. The angle which indentation 68 makes with the vertical plane is such that the overlap between central segment 52 and indentation 68 (FIG. 4A) is sufficient to provide a secure lock. However, it is not so great as to prevent central segment 52 from riding easily on the inclined plane of indentation 68 while the container is being closed. Preferably the angle which indentation 68 makes with the vertical plane is somewhat greater than the angle side wall 14 makes with the same plane.

Figure 2:
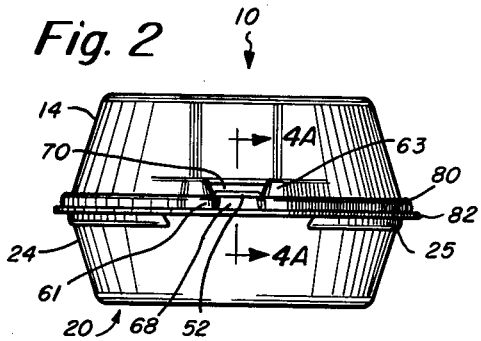
FIG. 2 is a view of the same container as in FIG. 1 showing the end having the latching mechanism (the front end)
Figure 3:
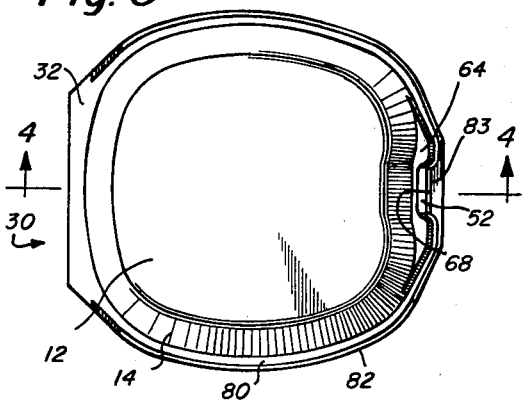
FIG. 3 is a top view of the same container as in FIGS. 1 and 2.

The female portion 60 of the latching means also includes a U-shaped slot 70 (FIG. 5) cut into chamber 62 with the outer edge 72 of slot 70 cut into shelf 64 and the inner edge 74 of slot 70 cut into indentation 68. As can be best seen in FIG. 5 slot 70 may be cut by a knife, die, or punch moving in a vertical plane (i.e. perpendicular to top wall 12). The width of slot 70 is such that when viewed in the vertical plane (FIG. 2) slot 70 is substantially wider than the thickness of central segment 52. Typically slot 70 may be about 3 times the thickness of central segment 52. It should be noted that if such a slot were cut in side wall 14 rather than shelf 64 the width of slot 70 when viewed in the vertical plane would be many times the preferred width which would substantially decrease the structural integrity of the container and increase the probability of the contents and/or vapors escaping from the container.

Figure 8:
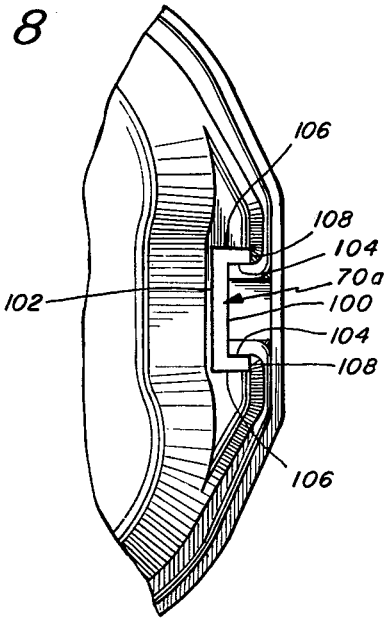
FIG. 8 is a fragmentary plan view of a portion of the cover showing the preferred configuration of slot.

In FIG. 8, a modified slot configuration is shown which is the preferred form of this invention. The slot 70*a* is generally U-shaped in plan view, as is the slot 70 shown in FIG. 7. However, unlike the slot 70, slot 70*a* is defined by straight inner and outer edges 100 and 102, straight inner and outer side edges 104 and 106, and straight front edges 108. The several edges are not joined by radii but rather meet at square corners. Consequently, the punch and die used to cut the slot 70*a* is made with readily machinable parts. The clearance between the punch and die necessary to accurately cut the slot must be in the order of 0.001 inch, and it will be recognized that the machining tolerances necessary to provide that clearance can be achieved without great difficulty. However, if the slot is to have the shape shown in FIGS. 5 and 7 the curved surfaces must be very carefully machined and maintained if the cutting operation is to be done effectively.

Hinge 30, dish 20, cover 10, and male portion 50 and female portion 60 of the latching means 40 are such that as cover 10 is rotated about hinge 30 toward the closed position, central segment 52 aligns with indentation 68. As the closing motion continues central segment 52 rides on indentation 68, the container being sufficiently deformable so that indentation 68 moves out over central segment 52. Finally as rims 16 and 26 come in contact central segment 52 slips into slot 70 and indentation 68 snaps back under indentation 52 securely locking the cover. The vertical extent of slot 70 and the memory of the material at the hinge which urges the container open cooperate to produce a click sound when the container is closed, which signals that the container is properly latched. In addition, preferably, the relative thickness of strip 36 and slots 31 and 33 forming hinge 30 are such that in this closed position there is also a slight compression of the parts of the hinge creating a bias in the hinge. If side wall 24 is pressed inward at a point just below central segment 52 so that central segment 52 disengages from indentation 68, the bias in hinge 30 will cause top 10 to move away from dish 20; thus the container may be opened with one hand.

Skirt 80 of cover 18 extends downwardly from rim 16 and forms a continuation of lower portion 61 of chamber 62 (FIG. 1). In the preferred embodiment the lower edge 82 of skirt 80 is flared outward and at the front of the container broadens into a flat projection 83 which serves to strengthen the female portion 60 of latching mechanism 40 and also to protect the latching mechanism 40 from being accidentally opened. The forming of protrusion 62 in two segments 61 and 63, and the U-shape of slot 70 and indentation 68 (FIG. 2) also serve to strengthen the latching mechanism. Ridge 25, which is described below serves as a stacking shoulder, may be formed just below rim 26 of dish 20 in order to strengthen that area of the container. Raised ribs 28 may be formed in base wall 22 so that material placed in the container will be raised slightly from the base wall 22. This prevents the hamburger bun from becoming soggy by permitting air to circulate under it and also strengthens the base of the container.

Figure 4B:
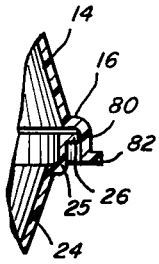
FIG. 4B is a fragmentary cross sectional view of one side of the container according to the invention taken through line 4B—4B of FIG. 4.

FIG. 4B shows the manner in which skirt 80 overlaps the edge of rim 26 to form a more effective closure for the container. Skirt 80 also serves as a guide to align cover 10 and dish 20 as the container is closed. The angled supporting segments 54 of the male portion 50 of the latching means also help to maintain the parts in correct alignment upon closing.

Figure 6:
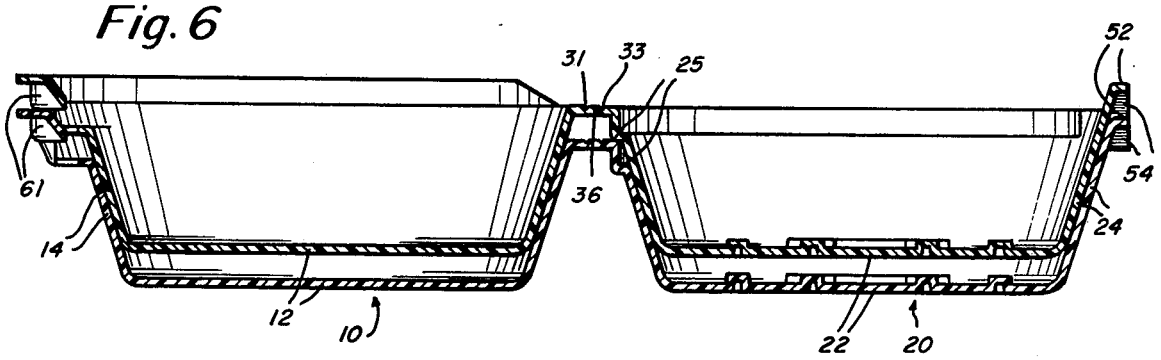
FIG. 6 is a cross sectional view of two containers according to the invention showing the manner in which one nests within the other.

The nesting feature of the containers is shown in FIG. 6. It can be seen in that figure that the lack of undercuts or reverse tapers in the containers allow sone to fit snugly into another. The vertical heights of ridge 25, skirt 80 and protrusion portion 61 provide positive stacking by virtue of the stock thickness of the material so that adjacent nested containers may be readily separated.

There has been described a novel deformable food container that can be easily closed and opened with one hand, provides a secure, tight, positive lock, can be trimmed and slotted during manufacture on the same machine, and has numerous other features. It is evident that those skilled in the art may now make numerous uses and modifications of and departures from the specific embodiments described herein without departing from the inventive concepts. For example cover 10 and dish 20, chamber 62, indentation 68, central segment 52, etc. may take on various shapes and dimensions, providing the critical relationships between the parts remain as described. The container may be composed of any suitable materials such as pressed fiber, pulp, etc. rather than the preferred plastic foam. Also the container may be inverted in the sense that the male portion 50 of the latching means may be located on cover 10 and the female portion 60 of the latching means may be located on dish 20. This embodiment of the invention would require dish 20 to be independently supported when the container is opened with one hand, but would retain the other advantages discussed above. Consequently the invention is to be construed as embracing each and every novel feature and novel combination of the features present in or possessed by the container herein described.

What is claimed is:

1. A deformable container comprising a bottom dish and a top cover having a connecting hinge at one end and a latching means having a male portion and a female portion at the other end, wherein:

said bottom dish comprises a base wall and side walls outwardly inclined from said base wall and terminating at their edges remote from said base wall in a flared first rim; at one end of said dish said first rim being integrally molded to said hinge and at the opposite end said first rim terminating at and being integrally molded to said male portion of said latching means;

said male portion of said latching means comprises a central segment lying in a plane substantially parallel to said base and displaced above the level of said first rim in a direction away from said base; said central segment being connected to the top of the side wall of the bottom dish; and supporting segments interconnecting said central segment and said first rim on each side of said central segment; said supporting segments also being connected to the top edge of said side wall; whereby the side wall, central segment, supporting segments and first rim form a relatively rigid structure free of hinge-like connections between the side wall and the male portion of the latching means;

said top cover comprises a top wall and side walls outwardly inclined from said top wall and terminating in a flared second rim; at one end of said cover said second rim being integrally molded to said hinge and at the opposite end said second rim terminating at and being integrally molded to said female portion of said latching means;

said female portion of said latching means comprises an outwardly protruding chamber formed at least in part in the cover side wall and disposed on the side of said second rim toward said top wall; a shelf defining the end of the protruding chamber nearer the top wall and connected to the cover side wall, said shelf being substantially parallel to said top wall;

an inwardly protruding indentation formed in said chamber, said indentation angling from the outer edge of said chamber toward the inner portion of said shelf;

and a U-shaped slot cut into said chamber with the outer circumference of the U cut into said shelf and the inner circumference of the U cut into the inwardly protruding indentation; said inner and outer circumferences of the slot being displaced from one another in a direction parallel to the plane of the shelf whereby the slot may be formed by a cutting tool moving perpendicular to the plane of said shelf;

and said hinge, said botton dish, said top cover, and said male and female portions of said latching means being constructed and arranged so that as said cover is rotated about said hinge toward the closed position said central segment rides on said inwardly sloping indentation until it snaps into said slot.

2. A deformable container in accordance with claim 1 wherein the width of said slot in a direction perpendicular to said shelf is substantially greater than the thickness of said flange so that said flange easily slips into said slot even when the parts are subject to normal distortion.

3. A deformable container in accordance with claim 2 wherein said hinge is biased so that upon release of said latching means said cover is urged away from said dish to bring said container into its open configuration.

4. A deformable container in accordance with claim 1 and further comprising a skirt integrally molded to and extending from the portion of said second rim not contiguous to said hinge, in a direction substantially parallel to said side walls, said skirt being integrally molded with the portion of said chamber that extends on the side of said second rim away from said top wall.

5. A container as defined in claim 1 further characterized by said U-shaped slot being defined by straight side edges whereby the cutting tool for forming the slot is free of curved cutting surfaces.

* * * * *